US005384754A

United States Patent [19]

Besson

[11] Patent Number: 5,384,754

[45] Date of Patent: Jan. 24, 1995

[54] PERPETUAL CALENDAR WATCH WITH ANALOG TIME DISPLAY

[75] Inventor: Rene Besson, Geneva, Switzerland

[73] Assignee: Montres Rolex S.A., Geneva, Switzerland

[21] Appl. No.: 11,827

[22] Filed: Feb. 1, 1993

Related U.S. Application Data

[63] Continuation of Ser. No. 668,675, Mar. 7, 1991, abandoned, which is a continuation of Ser. No. 340,473, Apr. 19, 1989, abandoned.

[30] Foreign Application Priority Data

Apr. 19, 1988 [CH] Switzerland ..... 01442/88

[51] Int. Cl.[6] ..... G04B 19/24; G04B 27/02; G04C 9/00

[52] U.S. Cl. ..... 368/28; 368/187; 368/190

[58] Field of Search ..... 368/28, 29, 31, 34, 368/69, 79, 185, 187, 190, 319

[56] References Cited

U.S. PATENT DOCUMENTS

| | | | |
|---|---|---|---|
| 4,090,353 | 5/1978 | Maeda et al. . | |
| 4,094,135 | 6/1978 | Nomura et al. | 368/187 |
| 4,185,453 | 1/1980 | Jaunin | 368/187 |
| 4,358,837 | 11/1982 | Yamazaki et al. | 368/69 |
| 4,419,018 | 12/1983 | Meyrat . | |
| 4,470,707 | 9/1984 | Chambon et al. | 88/74 |
| 4,600,316 | 7/1986 | Besson | 368/187 |
| 4,620,797 | 11/1986 | Besson et al. | 368/21 |
| 4,837,755 | 6/1989 | Besson . | |
| 4,847,776 | 7/1989 | Huang . | |
| 4,912,688 | 3/1990 | Syfert . | |

FOREIGN PATENT DOCUMENTS

| | | |
|---|---|---|
| 53-81163 | 7/1978 | Japan . |
| 2005055 | 4/1979 | United Kingdom . |
| WO8302340 | 7/1983 | WIPO . |

OTHER PUBLICATIONS

English Abstract of Japanese Pat. No. 53-81163.

*Primary Examiner*—Vit W. Miska
*Attorney, Agent, or Firm*—Sandler Greenblum & Bernstein

[57] ABSTRACT

An electronic watch having an electronic circuit to perform advanced features that is able to distinguish between a first case in which an access code for entry into a programming mode has been correctly entered and the programming operation has been correctly done, from a second case in which the access code has not been correctly entered and/or the programming has not been done correctly. Access to a programming mode of a perpetual calendar feature built into the watch is controlled by requiring at least one manipulation of a time-setting rod in view of its attribution to at least one function other than the functions of correction of the date and day, and to control the watch in the manner of an ordinary watch in the second case and to attribute, in this case to at least one manipulation of the rod, the functions of correction of date and day.

8 Claims, 3 Drawing Sheets

PERPETUAL CALENDAR WATCH WITH ANALOG TIME DISPLAY

This application is a continuation of application Ser. No. 07/668,675, filed Mar. 7, 1991, now abandoned; which is a continuation of application Ser. No. 07/340,473, filed Apr. 19, 1989, now abandoned.

FIELD OF THE INVENTION

The present invention relates to a timepiece that has a perpetual calendar and an analog time display. Such a timepiece comprises, e.g., at least one hour hand and one minute hand; at least one drive motor for the hands; an electronic control circuit synchronized by a quartz crystal; means for displaying the date and, occasionally, the day of the week; and a time-setting rod arranged to be subjected to several manipulations, each corresponding to a predetermined feature of the timepiece. The electronic circuit in the timepiece is structured to recognize an access code corresponding to the particular manipulations of the time-setting rod to permit entry into a programming mode of the perpetual calendar so as to program the calendar.

DISCUSSION OF BACKGROUND AND RELEVANT INFORMATION

A perpetual calendar of a timepiece, such as a watch, is designed to correctly display the date, taking into account the number of days in each month of the year and the occurrence of leap years, which include an extra day, i.e., February 29.

Certain electronic watches have perpetual calendars in which the parameters governing the display of the month, date and year are accessible only to the manufacturer of the watch or an experienced specialist, i.e., a watch repairman. These parameters are stored in the electronic circuit for later use. The operation of entering the parameters into the memory is called programming of the watch.

Various means exist for engaging the programming mode. The most common method is to use an external device that is available to only a select group, such as the watch manufacturer or its dealers and watch repairmen. An alternative approach is to build into the timepiece integrated elements that are necessary to carry out this programming.

If the ability to program a feature of the timepiece is built into the timepiece, it is desirable that an access code be provided, which is known by only a select group, so as to prevent erroneous programming by inexperienced or unknowledgeable persons. Applicant has developed a system described in Swiss patent application 4385/87-0, whereby a time-setting rod found on the timepiece is used to engage the programming mode and to make a parameter to be programmed correspond to each of three positions of this time-setting rod. The access code for a desired feature is entered by performing an unusual manipulation of this time-setting rod.

When a watch battery needs to be replaced, one of two situations can occur: 1) the watchmaker belongs to the aforementioned selected group and thus know how to access the programming mode as well as the programming of the watch itself, or 2) the watchmaker does not belong to the selected group and thus does not know how to access the programming mode of the watch.

SUMMARY OF THE INVENTION

Accordingly, an object of the present invention is to prevent a watchmaker from the non-selected group from having to declare his incompetence and having to send the client to a dealer who represents the watchmaker.

An advantage of the present invention is that the electronics in the timepiece can determine whether or not a person that is attempting to program the timepiece belongs to the select group.

Another advantage of the present invention is that the timepiece can determine whether a feature, such as a perpetual calendar, has been properly programmed.

To these ends, the invention includes an electronic watch having an electronic circuit to perform advanced features that is able to distinguish between a first case in which an access code for entry into a programming mode has been correctly entered and the programming operation has been correctly done, from a second case in which the access code has not been correctly entered and/or the programming has not been done correctly. The present invention proposes to control access to a programming mode of a perpetual calendar feature built into the watch by means of at least one manipulation of a time-setting rod, in view of its attribution to at least one function other than the functions of correction of the date and day, and to control the watch in the manner of an ordinary watch in the second case and to assign in this case to at least one manipulation of the rod the functions of the correction of the date and day.

BRIEF DESCRIPTION OF THE DRAWINGS

The foregoing and other objects, features and advantages of the invention will be apparent from the following more particular description of a preferred embodiment as illustrated in the accompanying drawings in which reference characters refer to the same parts throughout the various views. The drawings are not necessarily to scale, emphasis instead being placed upon illustrating the principles of the invention.

DETAILED DESCRIPTION OF THE PREFERRED EMBODIMENT

Figure 2A:
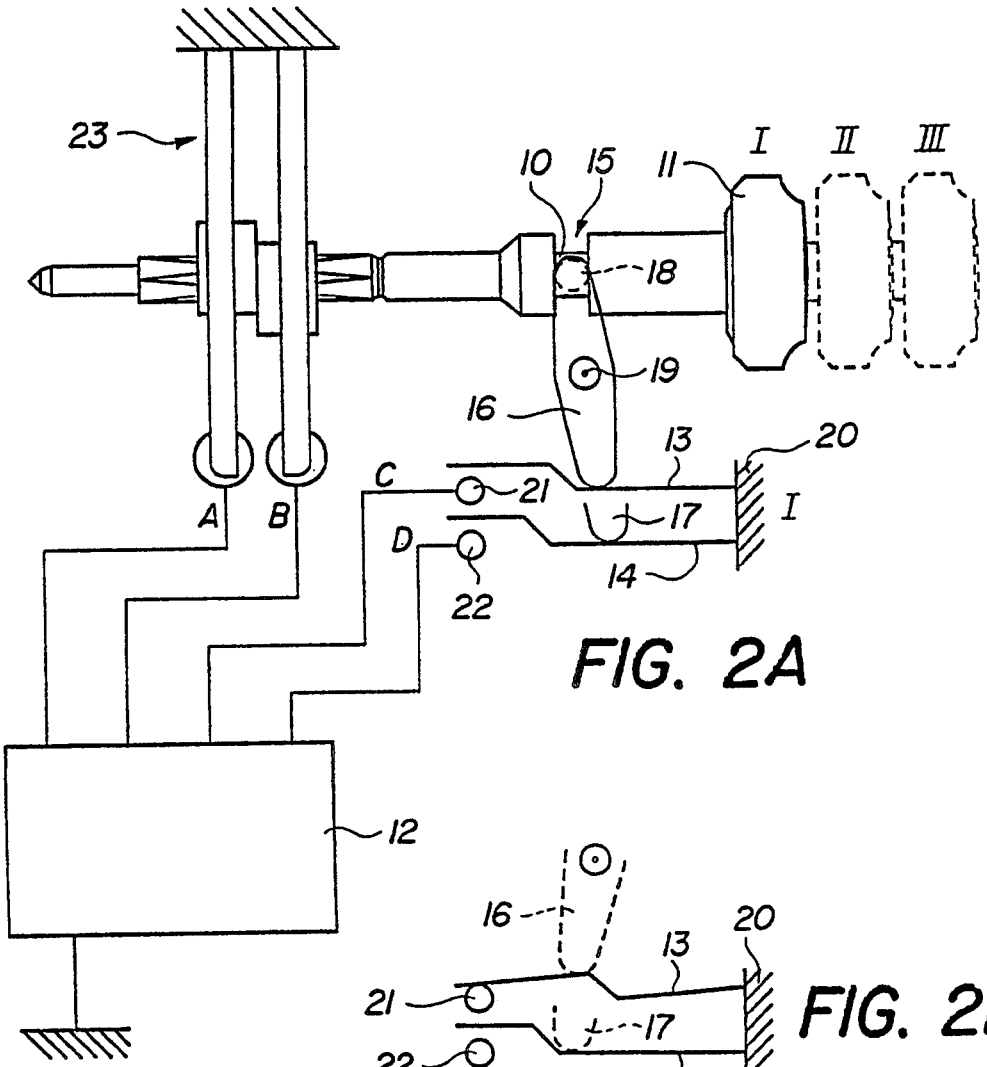
FIG. 2A is a schematic representation of two detector means that are used to transmit signals that are representative of the axial and rotational position of the time-setting rod of FIG. 1A, wherein the time-setting rod is shown in a first position.

A timepiece 1, such as a watch, has a conventional appearing time-setting rod 10, that is movable to any of three axial positions I, II and III, as indicated in FIG. 2A. In a manner described in the aforementioned Swiss patent, an unusual predetermined manipulation of the time-setting rod 10 constitutes an access code to gain entry to a programming mode of the watch and to the programming itself. The parameters that can be adjusted include the year of a four year cycle, the month and date. The entry of these parameters are carried out by manipulating the time-setting rod 10 after it has been brought into one of its three axial positions I, II or III.

An electronic circuit 12 built into the watch is designed to recognize a special manipulation of the time-setting rod 10 which constitutes the acceptance of the access code to place the watch into a programming mode. The electronic circuit 12 is also capable of distinguishing the case where, following an interruption of electrical power (for example, when a watch battery is replaced), the code for accessing the programming mode of the watch has been correctly entered and the programming has been correctly done, from the case where the access code has not been correctly entered and/or where the programming has not been correctly done.

In the framework of the present invention, the term "correctly" is to be understood in a broad sense, meaning on the one hand that the operator, unaware of the existence of an access code, has not attempted to enter it to begin programming, and on the other hand, that the operator, although aware of the existence of an access code and the code itself, has, despite one or more attempts, not succeeded in entering the access code.

In the first case, the electronic circuit 12 of the watch has a means for recognizing that the watch has a perpetual calendar feature, and that access to has the function of correcting the date and day is unnecessary. In fact, access to these functions may be hazardous, because if they are haphazardly changed, the possibility exists that the settings may be erroneously entered. Because these functions are undesirable and useless, they are eliminated, which frees at least one position of the time-setting rod 10 for other advanced functions. One of the positions of the time-setting rod 10 remains attributed to the conventional function of setting the time displayed by the watch. The advanced functions, which can be assigned to positions of the time-setting rod 10 by way of replacing the functions of correcting the date and day, are numerous and varied. One type of useful advanced feature for a watch is the inclusion of a dual time zone indicator, or the ability to be able to move the hour hand forward or backward without disturbing the counting of the minutes and seconds.

In the second case, the electronic circuit 12 has a means of distinguishing that the watch does not have a properly functioning perpetual calendar feature, so that one of the positions of the rod is assigned to the correction of the date. In the case where the rod has three positions, one of the positions corresponds to the correction of the date, a second position corresponds to the correction of the day, and the third position corresponds to the function of correcting the time. Alternatively, the watch can be constructed so as to provide a first position which is neutral, a second position for correcting the day when turning the time-setting rod 10 in one direction and adjusting the date when the time-setting rod 10 is turned in the opposite direction, and a third position for setting the time.

When the battery runs down, the watch owner will preferably go to a watchmaker or the manufacturer's dealer who is familiar with the operation of the watch and knows how to program it so that it retains its perpetual calendar feature. If the watch owner cannot find such a facility, while the perpetual calendar feature can not be programmed, the time keeping function continues to operate. Only the perpetual calendar feature is temporarily suppressed, while secondary functions, such as the control for time zones etc., are temporarily replaced by correction functions for the date (and possibly the day), which become indispensable in the absence of perpetual calendar feature.

Figure 1A:
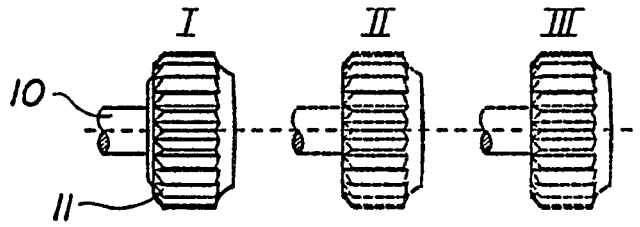
FIG. 1A illustrates three possible positions of a time-setting rod used with a timepiece of the preferred embodiment of the invention.
Figure 2B:
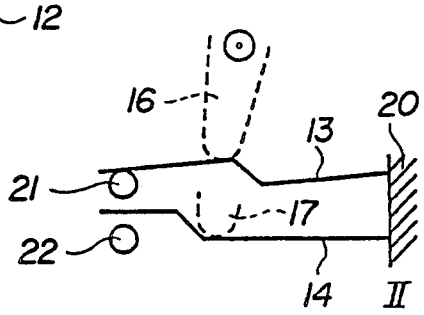
FIG. 2B illustrates the time-setting rod of FIG. 2A in a second position.
Figure 2C:
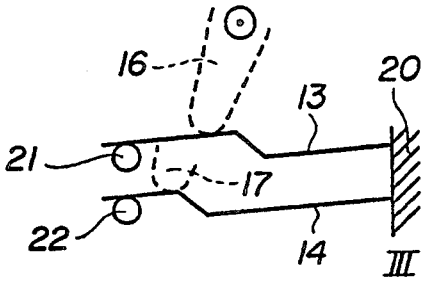
FIG. 2C illustrates the time-setting rod of FIG. 2A in a third position.

Referring to FIG. 1A, the watch, which is not shown, comprises the time-setting rod 10 which has a crown 11 attached at one end thereto. The crown 11 (and consequently the time-setting rod 10) can be positioned at the three axial positions I, II and III. A means 15 for detecting the axial position of the time-setting rod (FIG. 2A) is positioned proximate the remaining end of the time-setting rod 10 that is housed in the watch's case. Information generated by the axial position detector means 15 is transmitted to the electronic circuit 12. These axial positions detected by the position detector are represented by FIGS. 2A, 2B, and 2C.

Figure 1B:
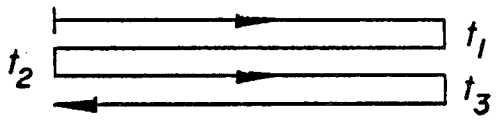
FIG. 1B illustrates a series of possible displacements of the time-setting rod used with the embodiment in FIG. 1A to gain entry to a programming mode of the timepiece of the preferred embodiment.

FIG. 1B illustrates the manipulation of the time-setting rod 10 for entering the access code to get into the programming mode. The dual back-and-forth movement of the time-setting rod 10 is interpreted by the electronic circuit 12 as the code for gaining entry to the programming mode for the perpetual calendar. Furthermore, to improve the security of the system, the particular sequence can be made dependent on temporal data. That is, the manipulation of the time-setting rod 10 can be required to be entered in a predetermined interval of time T, such as 2 seconds.

Figure 1C:
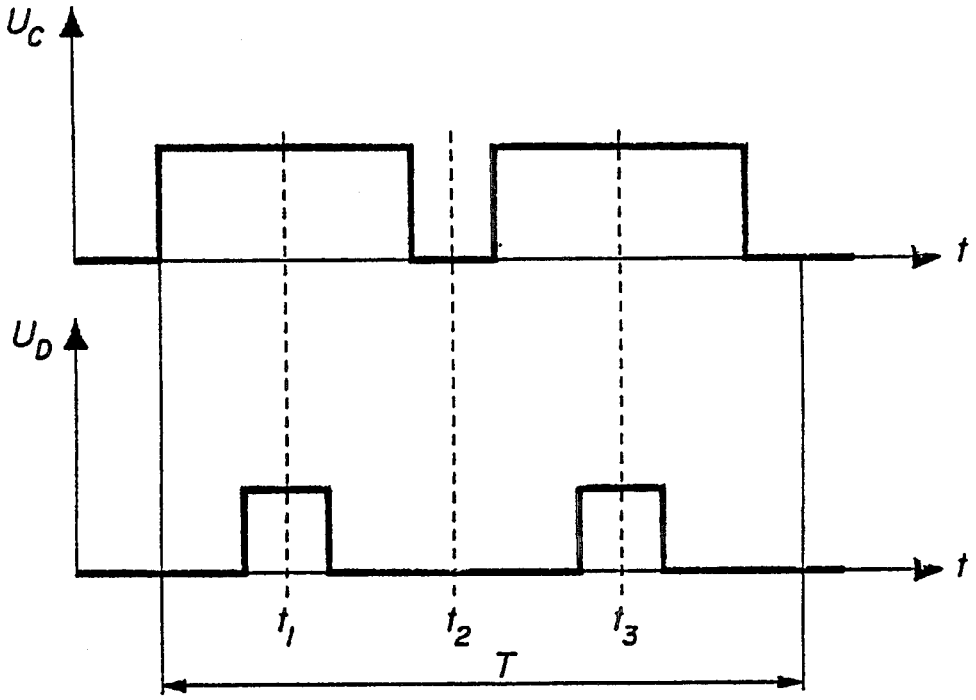
FIG. 1C graphically illustrates signals generated by the displacement of the time-setting rod used in the preferred embodiment.

FIG. 1C illustrates signals $U_C$ and $U_D$ which are generated by the displacement of the time-setting rod 10 and transmitted to the electronic circuit 12 (FIG. 2A) via two conductors C and D. These signals are generated by the closing and opening of two contact blades 13 and 14 of the axial position detector means 15 that selectively engage terminals 21 and 22, respectively, illustrated in FIGS. 2A, 2B, and 2C. The time period $t_1$ corresponds to the end of the first forward displacement of the time-setting rod 10. Time period $t_2$ corresponds to the first return, while time period $t_3$ corresponds to the second forward displacement of the time-setting rod 10.

As shown in FIG. 2A, the crown 11 can be moved to three axial positions I, II and III, which correspond to three positions of the time-setting rod 10. FIGS. 2A, 2B and 2C illustrate the various states of the contact blades 13 and 14 of the axial position detecting means 15. The axial position detecting means 15 comprises two levers 16 and 17 (or alternatively, a dual lever) that are journalled at 18 to the time-setting rod 10 of the watch. The axial movement of the time-setting rod 10 between positions I, II, and III causes the levers 16 and 17 to pivot about an axis 19 and selectively move the contact blades 13 and 14 into engagement with the terminals 21 and 22.

FIG. 2A shows the position of the contact blades 13 and 14 when the time-setting rod 10 is at position I. FIG. 2B illustrates the positions of the contact blades 13 and 14 when the time-setting rod 10 is at position II.

FIG. 2C illustrates the positions of the contact blades 13 and 14 of the axial position detecting means 15 when the time-setting means is at position III. By changing the axial position of the time-setting rod 10 of the watch, the levers 16 and 17 act against the contact blades 13 and 14 so that the conductors C and D are selectively connected to ground 20. The selective grounding of conductors C and D by the axial position detecting means 15, as a result of the axial movement of the time-setting rod 10, results in the production of various signals that are interpreted by the electronic circuit 12 as the entry of an access code.

When the crown 11 is in position I (FIG. 2A), the two contact blades 13 and 14 are in an upper position; i.e., the contact between ground 20 and terminals 21 and 22, positioned at the ends of the conductors C and D, are open.

When the crown 11 is moved to position II, as shown in FIG. 2B, the contact blade 13 is in its lower position so as to complete and electrical connection between conductor C and ground 20. However, the contact blade 14 remains in its upper, or open, position.

When the crown 11 is moved to position III, illustrated in FIG. 2C, the two contact blades 13 and 14 contact terminals 21 and 22. The result is that both conductors C and D are connected to ground 20.

Figure 3A:
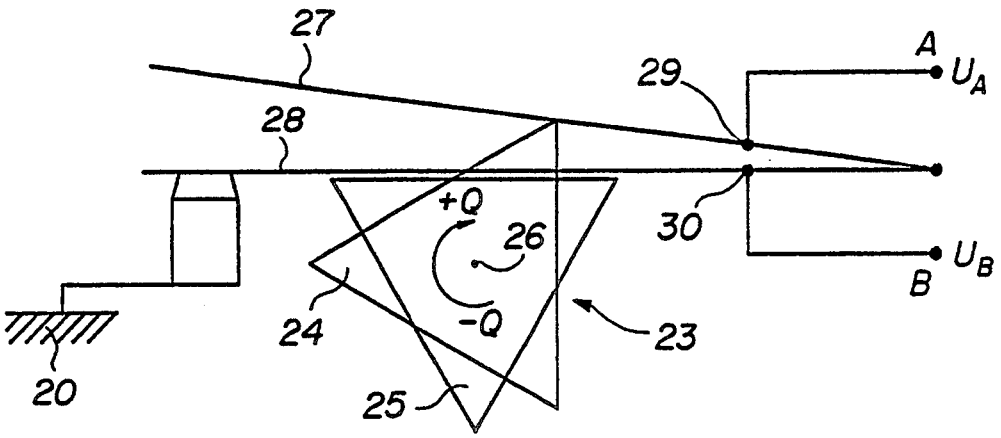
FIG. 3A illustrates a rotation detector used with the preferred embodiment of FIG. 1 to determine the rotation position of the time-setting rod.

A rotation position means 23, shown in a front view in FIG. 2A and in a profile view in FIG. 3A, comprises two cams 24 and 25, in the shape of two equilateral triangles that rotate about an axis 26. The two cams 24, 25 are offset with respect to one another, and act on two contact blades 27 and 28 which are arranged to selectively connect conductors A and B to ground 20 via two terminals 29 and 30. The operation of the rotation position means 23 functions to produce signals $U_A$ and $U_B$, which are interpreted by the integrated circuit 12.

Figure 3B:
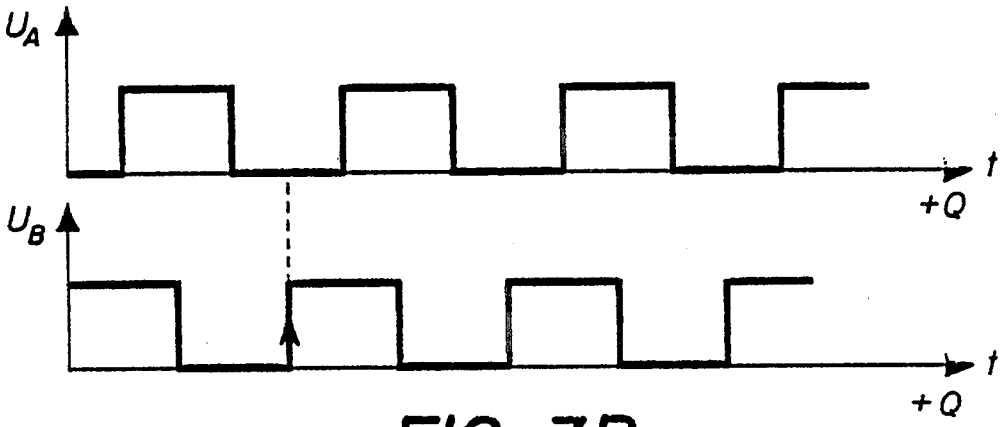
FIGS. 3B and 3C depict digital signals that are generated by the rotation of the time-setting rod of FIG. 2A in different respective directions of rotation.
Figure 3C:
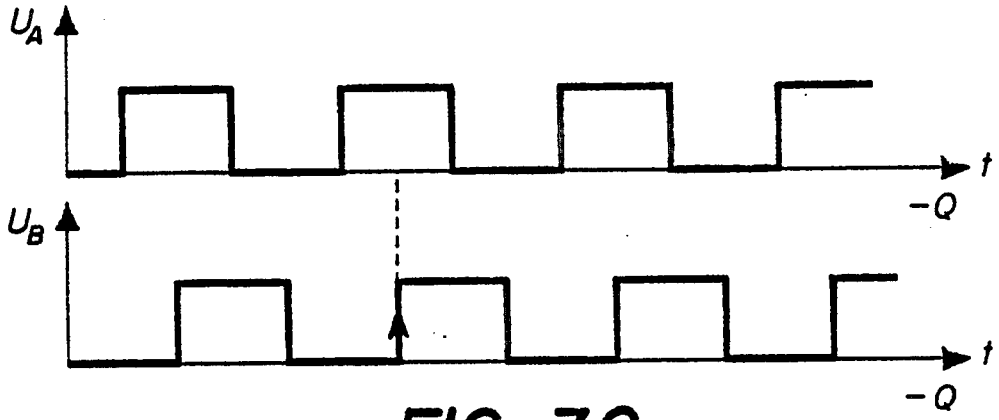

As shown in FIGS. 3B and 3C, signals $U_A$ and $U_B$ produced in the conductors A and B are cyclical. Along the abscissa of each of the graphs of FIGS. 3B and 3C, the angular direction Q of the cams 24 and 25 is shown, corresponding to the direction of rotation +Q and −Q, represented by the double arrow in FIG. 3A.

FIG. 3B illustrates the pulse stream flow that is produced by conductors A and B when the time-setting rod 10 is rotated in one direction, which causes the cams to rotate in the +Q direction (FIG. 3A). FIG. 3C illustrates the pulse stream flow that is produced by conductors A and B when the time-setting rod is rotated in an opposite direction, −Q, as indicated in FIG. 3A. The pulse streams represented graphically in FIGS. 3B and 3C are used by the electrical circuit 12, in conjunction with signals $U_C$ and $U_D$ to generate the access code that is needed to enter the programming mode of the perpetual calendar. It is to be noted that the axial position detector means 15 and rotation position means 23 are known in and of themselves.

While the invention has been particularly shown and described with reference to the preferred embodiment thereof, it will be understood by those skilled in the art that various alterations in form and detail may be made without departing from the spirit and scope of the invention as defined by the claims which follow.

I claim:

1. A timepiece for displaying a time of day, said timepiece having a perpetual calendar, comprising:

an electronic control circuit synchronized by a quartz crystal;

a first hand for indicating an hour;

a second hand for indicating a minute;

a drive motor for rotating said first hand and said second hand about an axis in response to a signal from said electronic control circuit;

means for perpetually displaying a date indicated by said perpetual calendar; and a time-setting rod that is subjectable to a plurality of axial and rotational manipulations that correspond to a predetermined access code for programming said perpetual calendar, said axial and rotational manipulations of said time-setting rod producing various signals that are inputted to said electronic control circuit, said electronic control circuit including means for recognizing said access code so as to permit passage into a mode for programming said perpetual calendar, said electronic control circuit further being provided with means for distinguishing a first case in which said access code has been properly entered and a programming of said perpetual calendar has been correctly performed, from a second case in which at least one of said access code or said programming of said perpetual calendar has been improperly performed, wherein predetermined axial and rotational manipulations of said time-setting rod set a first function of said timepiece when said electronic control circuit distinguishes said first case, while said predetermined axial and rotational manipulations of said time-setting rod set a second function of said timepiece when said electronic control circuit distinguishes said second case.

2. The timepiece of claim 1, wherein said perpetual calendar also indicates the day of the week.

3. The timepiece of claim 1, said access code is also dependent upon the input of temporal data.

4. The timepiece of claim 1, wherein in said first case said predetermined manipulation of said time-setting rod is assigned to a time zone function in place of the function of programming said date of said perpetual calendar.

5. The timepiece of claim 2, wherein in said first case said predetermined manipulation of said time-setting rod is assigned to a time zone function in place of the function of programming said day and date of said perpetual calendar.

6. The timepiece of claim 1, in which said time-setting rod has a plurality of axial positions, wherein one axial position of said time-setting rod is assigned for another advanced feature of said timepiece in said first case, while in said second case said position is assigned for correcting the day and date that is displayed by said perpetual calendar, a third axial position of said time-setting rod in said first and second cases being reserved for setting the time to be displayed on said timepiece.

7. A timepiece having a perpetual calendar, comprising:

means for perpetually displaying a date indicated by said perpetual calendar;

a time-setting rod that is subjectable to a plurality of axial and rotational manipulations corresponding to a predetermined access code for programming said perpetual calendar, said axial and rotational manipulations of said time-setting rod producing various signals that represent at least one access code; and an electronic control circuit that controls said perpetual calendar, comprising:

means for recognizing said at least access code so as to permit passage into a mode for programming said perpetual calendar; and means for distinguishing a first case in which said access code has been properly entered and a programming of said perpetual calendar has been correctly performed, from a second case in which either said access code has been improperly entered or said programming of said perpetual calendar has been improperly performed, wherein predetermined axial and rotational manipulations of said time-setting rod set a first function of said timepiece when said distinguishing means distinguishes said first case, while said predetermined axial and rotational manipulations of said time-setting rod set a second function of said timepiece when said distinguishing means distinguishes said second case.

8. The timepiece of claim 7, wherein said at least one access code is also dependent upon the input of temporal data.

* * * * *